US007602370B2

(12) United States Patent
Yamamoto et al.

(10) Patent No.: US 7,602,370 B2
(45) Date of Patent: Oct. 13, 2009

(54) LIQUID CRYSTAL DISPLAY DEVICE

(75) Inventors: Tsunenori Yamamoto, Tokyo (JP); Daisuke Kajita, Tokyo (JP); Ikuo Hiyama, Tokyo (JP)

(73) Assignee: Hitachi Displays, Ltd., Chiba (JP)

( * ) Notice: Subject to any disclaimer, the term of this patent is extended or adjusted under 35 U.S.C. 154(b) by 704 days.

(21) Appl. No.: 10/984,072

(22) Filed: Nov. 9, 2004

(65) Prior Publication Data

US 2005/0162584 A1 Jul. 28, 2005

(30) Foreign Application Priority Data

Jan. 23, 2004 (JP) ..... 2004-016209

(51) Int. Cl.
*G09G 3/36* (2006.01)

(52) U.S. Cl. ..... 345/102; 345/88

(58) Field of Classification Search ..... 345/102, 345/87–88; 362/97.2

See application file for complete search history.

(56) References Cited

U.S. PATENT DOCUMENTS

| | | | | |
|---|---|---|---|---|
| 6,115,016 | A * | 9/2000 | Yoshihara et al. | 345/88 |
| 2003/0080932 | A1 | 5/2003 | Konno et al. | |
| 2004/0041760 | A1 | 3/2004 | Tsumura et al. | |
| 2005/0259064 | A1 * | 11/2005 | Sugino et al. | 345/102 |

FOREIGN PATENT DOCUMENTS

| | | |
|---|---|---|
| JP | 2001-272938 | 10/2001 |

OTHER PUBLICATIONS

U.S. Appl. No. 09/695,174, filed Oct. 25, 2000, Yamamoto et al.
U.S. Appl. No. 09/532,740, filed Mar. 22, 2000, Aratani et al.
Hideyo Ohtsuki et al., "40.5L: Late News Paper: 18.1-inch XGA TFT-LCD with Wide Color Reproduction Using High Power LED-Backlighting", pp. 1154-1157, 2002.
Kenichi Iwauchi et al., "Development of Backlight System with Wider Color Gamut—Single Sensor Feedback Control of RGB-LED-" Technical Report of lEICE, EID2002-35 (Sep. 2002), pp. 25-28.
T. Yamamoto et al., "Proposal of the Index Parameter for Motion Picture Quality in LCDs", pp. 1423-1424, (2002).

* cited by examiner

*Primary Examiner*—Amr Awad
*Assistant Examiner*—Yong Sim
(74) *Attorney, Agent, or Firm*—Hogan & Hartson LLP

(57) ABSTRACT

A liquid crystal display device of the present invention is configured of a liquid crystal display unit for displaying an image, a backlight unit controllable for each color that radiates light at the liquid crystal display unit, a display controller for controlling a display of the liquid crystal display unit, and an emission control circuit for controlling an emission of the each color of the backlight unit, wherein the emission control circuit performs control so that emission start timing and emission end timing in a sequential emission period of the each color of the backlight unit match in all colors.

9 Claims, 9 Drawing Sheets

LIQUID CRYSTAL DISPLAY DEVICE

BACKGROUND OF THE INVENTION

1. Field of the Invention

The present invention relates to a liquid crystal display device comprising a backlight as a lighting system and particularly, to the liquid crystal display device whose motion picture performance is heightened by controlling the backlight.

2. Description of the Related Art

Although a CRT (Cathode Ray Tube) is a mainstream as a display device until now, these years an active matrix liquid crystal display device (hereinafter referred to as "LCD") is pervading. The LCD is a display device utilizing light transparency of a liquid crystal, does not emit light by itself, and makes a display by transmitting/shielding light of a backlight located at a back face Although there are many florescent tubes as the backlight of the LCD until now, in order to improve color reproductivity of a display image, these years there is a report of using a light emission diode (hereinafter referred to as "LED" as the backlight, for example, a non-patent document 1 of SID Digest pp. 1154 in 2002 and the like. Because in this LED backlight a temperature property of a red (hereinafter referred to as "R") LED is different from those of a green (hereinafter referred to as "G") LED and a blue (hereinafter referred to as "B") LED, it is necessary to provide an adequate feedback circuit in order to display a same color over long hours.

On the other hand, for example, it is reported a system of performing a color adjustment by displacing emission periods of the three colors RGB, configuring feedback circuits of the three colors by one sensor, and adjusting the emission period of each color as in presentations of a non patent document 2 of p. 25 of IEICE 2002-35 (2002-09) in Technical Report of the Institute of Electronics, Information and Communication Engineers and a non patent document 3 of Color Forum Japan 2002, 6-3.

In addition, as a luminance adjustment method of the LED backlight is shown a method (Pulse Width Modulation, hereinafter referred to as "PWM") of adjusting luminance by adjusting an emission period for each LED as in FIG. 16 of a patent document 1 of Japanese Patent Laid-Open Publication No. 2001-272938.

But if controlling the emission periods of the LCD of the three colors RGB by methods in the patent document 1 and the non patent document 2, there occurs a phenomenon of coloring inside an edge blur in displaying a motion picture because emission timing and emission centers of the three colors RGB are displaced.

A phenomenon of the edge blur in displaying the motion picture in an LCD is reported at pp. 19-26 (1996-06) of IEICE 96-4 in Technical Report of the Institute of Electronics, Information and Communication Engineers and the like. According to these, the blur occurs at an edge of a motion image due to a discord between the motion image of a hold-type display and an eye movement by a pursuit of a human being.

Here will be described coloring at an edge when making an LED of each color of the RGB the PWM control as in the patent document 1 with using the LED as the backlight, referring to FIG. 16.

In an upper portion of FIG. 16 a vertical axis is time and a horizontal one is a moving direction of a motion picture display object on an LCD. The each LED of the RGB simultaneously lights, and emission intensity thereof is different according to the color; therefore, for example, the PWM control of extinguishing the LED in order of the B, R, and G is performed.

On the other hand, a lower portion of FIG. 16 shows a brightness property when a human being's eyes see the image of the motion picture display object. A horizontal axis is a moving direction and a vertical one is brightness. Because when the human being's eyes see a moving object, they observe it while following in the moving direction and recognize an integration value as brightness, at an edge of a side of the object moving direction firstly B is strong, R joins therein, and lastly G joins therein, and thus white results in being displayed. On the other hand, at the edge of the opposite side of the object moving direction firstly B disappears, next R decreases, and lastly G results in remaining.

In addition, according to the same principle, the coloring similarly occurs at an edge of a motion picture display when the emission periods of the RGB are displaced as in the non patent documents 2 and 3.

Consequently, also when emission elements of individual control of the three-color RGB such as an LED are used as a backlight, a liquid crystal display device is strongly requested that can clearly display a motion picture without generating the coloring at an edge blur portion in displaying the motion picture.

SUMMARY OF THE INVENTION

In accordance with one embodiment of a liquid crystal display device of the present invention, the device comprises a liquid crystal display unit for displaying an image, a backlight unit controllable for each color that radiates light at the liquid crystal display unit, a display controller for controlling a display of the liquid crystal display unit, and an emission control circuit for controlling an emission of the each color of the backlight unit, wherein the emission control circuit performs control so that emission start timing and emission end timing in a sequential emission period of the each color of the backlight unit match in all colors.

The emission control circuit performs control so that an emission center in a sequential emission period of each color of a backlight unit substantially matches in all colors.

The emission control circuit divides an emission period of at least one color into a plurality of emissions and controls them in a sequential emission period of each color of a backlight unit.

The sequential emission period is set for each one-image display period (for each frame) of a liquid crystal display unit, that is, a sequential emission of at least one color is divided into a plurality of sub-emissions out of an emission of each color within one frame.

Emission intensity of the backlight is adjusted by controlling a length of sub-emission periods of each color, and it is desirable that emission centers of the sub-emission periods of the each color substantially match.

It is desirable that displacement of emission timing of each color within the sequential emission period is at least not more than three milli-seconds, and preferably not more than one milli-second.

It is desirable that the sequential emission period repeats twice within a one-image display period (one frame) and reduces a flicker interference by making an interval thereof not less than three milli-seconds.

It is desirable to divide an emission area of the backlight unit into not less than two.

DESCRIPTION OF THE PREFERRED EMBODIMENTS

Here will be more concretely described the present invention, according to embodiments.

Embodiment 1

Figure 1:
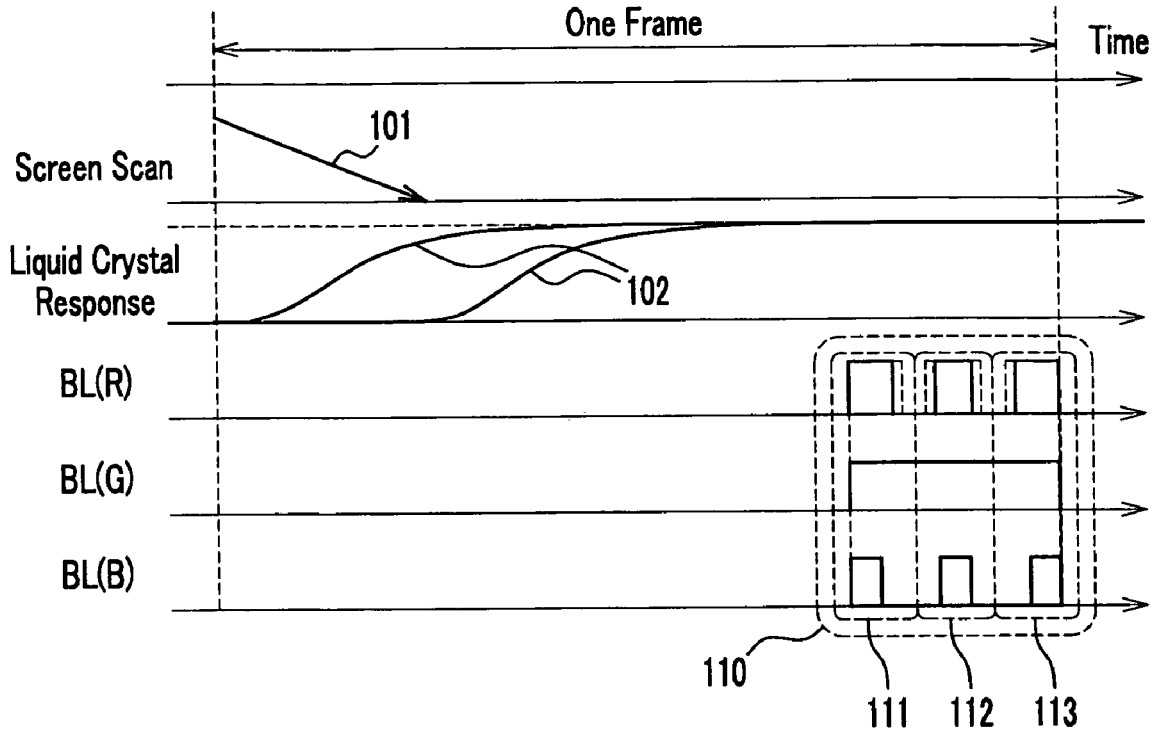
FIG. 1 is a sequence diagram of a liquid crystal display device of an embodiment 1 of the present invention.
Figure 2:
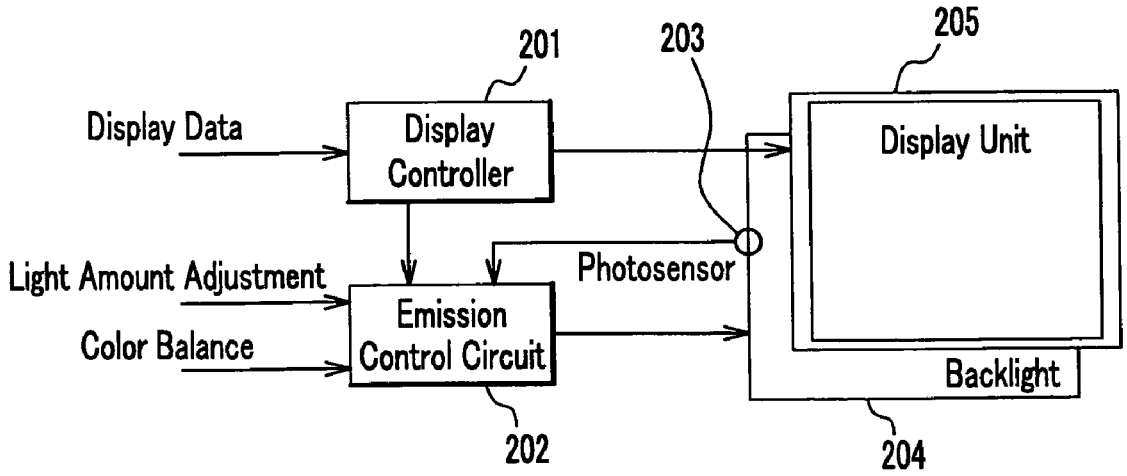
FIG. 2 is a block diagram of the liquid crystal display device of the embodiment 1.

A display sequence diagram of a liquid crystal display device of the embodiment is shown in FIG. 1 and a block diagram thereof is shown in FIG. 2. A configuration of the liquid crystal display device of the embodiment comprises, as shown in FIG. 2, a display controller 201, an emission control circuit 202, a photosensor 203, a backlight 204, and a display unit 205.

The display unit 205 uses a liquid crystal display panel adopting an active matrix in an in-plane-switching liquid crystal display mode; and the backlight 204 uses as a light source an LED that can independently control the three colors RGB. The display unit 205 is controlled by the display controller 201, based on display data sent from an image source. In addition, lighting of each color of the RGB of the backlight 204 is controlled by the emission control circuit 202, based on a timing signal from the display controller 201 and information and direct input data of a light amount adjustment from the photosensor 203.

Next will be described the display sequence of one frame (image display period of one screen) of the embodiment, using FIG. 1. The display data of one frame (one image) sent from the image source is written in the display unit 205 in time of about one fourth frame by the display controller 201 through a screen scan (101 in FIG. 1).

Each pixel of the display unit 205 starts a response just after respectively written (102 in FIG. 1) and almost ends the response at a timing of about a half to around three fourths of a one-frame period according to a write timing. After then, the LED of each color of the RGB of the backlight 204 emits light within a sequential emission period 110.

In the LED used in the embodiment, G is lowest, R is next high, and B is highest in emission efficiency as an LED element. Although a ratio of each element number used is made R:G:B=1:2:1, each emission period still has to be made G>R>B in order to display standard white in use at a rated current when an adjustment of emission intensity is controlled according to the emission period.

Figure 16:
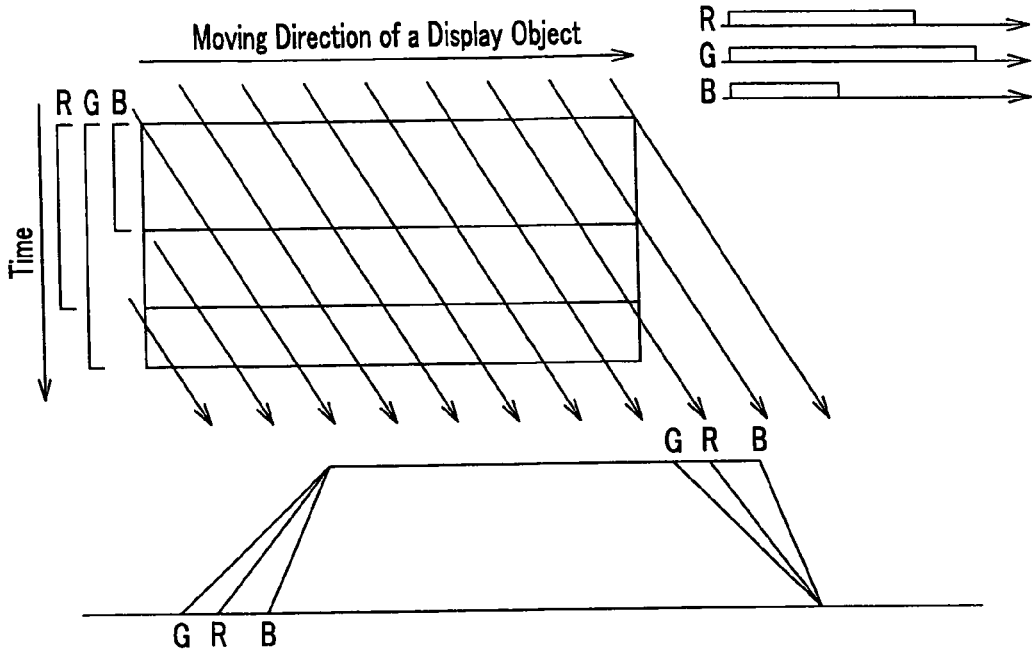
FIG.16 Prior Art
FIG. 16 is a drawing showing what an edge blur portion looks like in displaying a motion picture in a liquid crystal display device of a conventional example.
Figure 17:
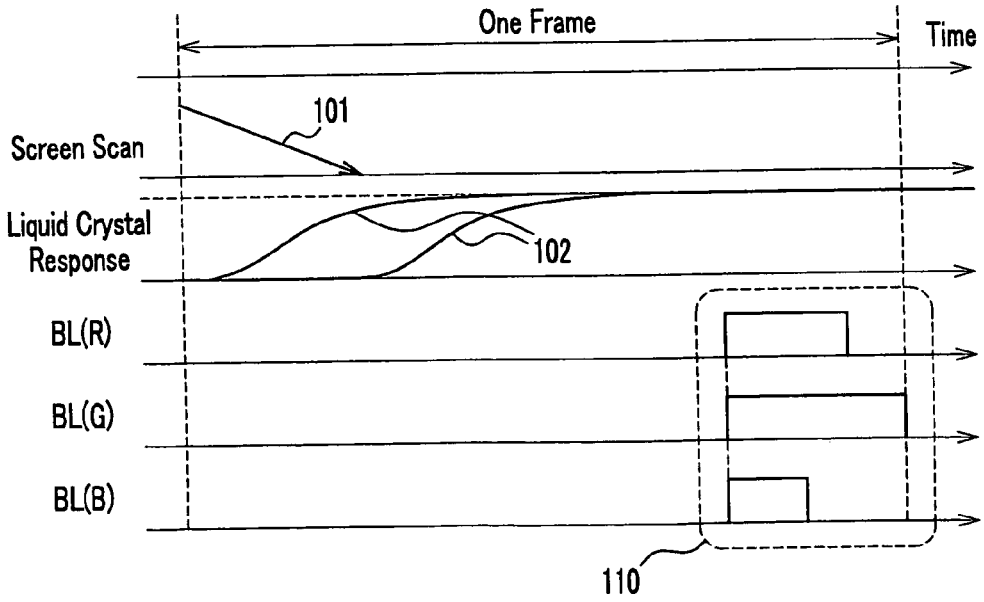
FIG.17 Prior Art
FIG. 17 is a display sequence diagram of the liquid crystal display device of the conventional example.

Here, when starting an emission with uniforming a start timing within the sequential emission period 110 of each color of the RGB as shown in FIG. 17 of a display sequence of a conventional example, it is described as a problem that coloring occurs at an edge as shown in FIG. 16 in displaying a motion picture.

Consequently, as shown in FIG. 1, the embodiment controls each sub-emission of the RGB so that a first emission start timing and last emission end timing of the RGB match within the sequential emission period 110 by dividing the sequential emission period 110 of the backlight 204 (BL (B), BL (G), and BL (B)) for each one frame into three sub-emission periods 111, 112, and 113.

In the embodiment it is designed that an emission of the G is continuously emitted over all the sub-emission periods; an emission length of the R is about 60% of the G, an emission of the R starts together with that of the G in the first sub-emission period 111, and an emission length of the R is about 60% of the whole sub-emission period 112, making a center thereof a center of a sub-emission period thereof; and the emission of the R ends together with that of the G in the sub-emission period 113. In addition, although an emission of the B is same as that of the R, an emission length of the B is designed to be about 40% of the G.

The adjustment of the emission intensity is controlled (PWM control) according to increase/decrease of the emission length as described above, and even when nothing but the emission period of the R for a color tone compensation and the like are adjusted, for example, as shown in dotted lines of FIG. 1, the emission start timing and emission end timing of the three colors RGB are made not to be displaced, and the sub-emission period 112 is changed to any of front/back within it; whereas only the back is changed within the sub-emission period 111, and only the front is changed within the sub-emission period 113.

Figure 3:
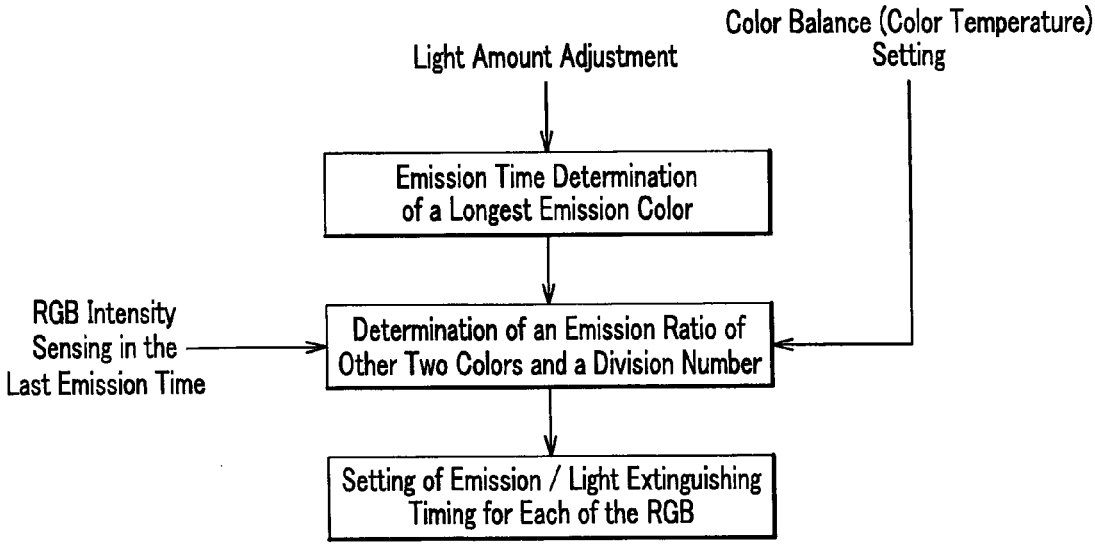
FIG. 3 is a control sequence diagram of an emission control circuit of the liquid crystal display device of the embodiment 1.

The emission of the each color of the RGB is controlled by the emission control circuit 202. A control sequence thereof is shown in FIG. 3. Firstly, the emission time of the longest emission color (G in the embodiment) is determined according to a set value of a light amount adjustment directly input.

Next, a ratio of emission periods of the other two colors (R and B in the embodiment) is determined according to set values of emission intensity and a color balance (color temperature of display colors) of the RGB in the last emission detected by the sensor 203.

Although a number (division number) of sub-emission periods within a sequential emission period in one frame is fixed as three in the embodiment, there is also some case where the division number is desirable to be increased not less than three when the ratios of the emission periods of the RGB are extreme. And lastly, emission timing and light extinguishing timing are set for each of the RGB.

Figure 4:
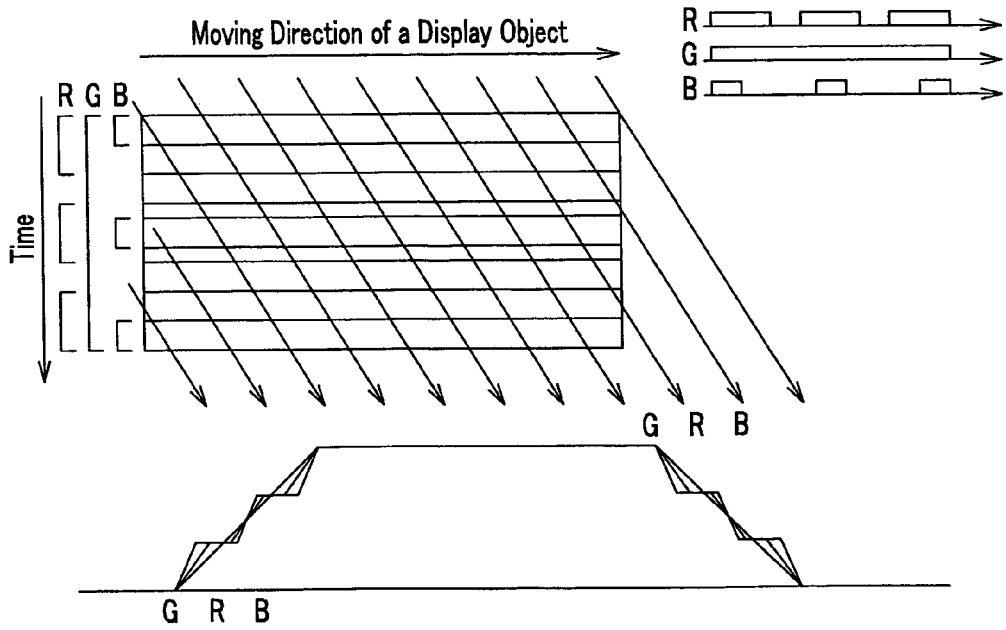
FIG. 4 is a drawing showing what an edge blur portion looks like in displaying a motion picture in the liquid crystal display device of the embodiment 1.

Thus in a case of a motion picture being displayed when the emission start timing and the emission end timing match for all the colors of the RGB within the sequential emission period 110, FIG. 4 shows what the picture looks like for a human being's eyes. Compared to FIG. 16 of the conventional example, it turns out that lines of the RGB are not very displaced, and that thus the coloring becomes difficult to occur.

Because although there is no report that the coloring is eyeballed if how much displacement there is in the emissions of the RGB, it is said that a pulse number, which a nerve ganglion cell of a retina of a human being can output per second, is about 300 as one opinion (for example, see P. 89 of "Visual Perception" of Academic Press (in 1990) by L. Spillmann and J. S. Werner). Therefore, it is foreseen that the coloring is eyeballed unless the displacement is made at least not more than three milli-seconds.

In addition, although when practically considering a motion picture in a television broadcast and the like, statistics of a motion speed in television programs is not known, there is a report that a general motion is three to six degrees/second and a motion of around ten degrees/second fairly frequently occurs (for example, see pp. 9-16 of IE 75-95 (in 1975) of "Image Quality of Motion Image and Television Signal Method" in Technical Report of Electric Communication Society by Miyahara). Here, ten degrees/second are equal to 0.6 min/milli-second, and assuming that a minimum separation threshold of a person with normal eyesight of 1.0 is one minute, the coloring results in being eyeballed if there exists the displacement of the emission of 1.66 milli-seconds. Particularly, because a sport program and the like is a motion picture whose moving speed is faster, the displacement of the emission is desirable to be not more than one milli-second.

In the embodiment the emission length of the G is about four milli-seconds, and there are two times of 1.2 milli-seconds as a period when the G is emitted and the B is not emitted. Because these are larger than one milli-second and smaller than 1.66 milli-seconds, the coloring can be suppressed to an extent not almost seen. Meanwhile, although there are two times of 0.8 milli-second as a period when the G is emitted and the R is not emitted, this is smaller than one milli-second, and therefore, the coloring can be suppressed.

Thus because the liquid crystal display device of the embodiment uses the LED of the three colors RGB controllable for the each color as a backlight and matches the emission start timing and the emission end timing of all the colors within the sequential emission period of the backlight in a one-frame period, it can improve a motion picture display property by reducing the color displacement at an edge blur portion in displaying the motion picture.

Embodiment 2

Figure 5:
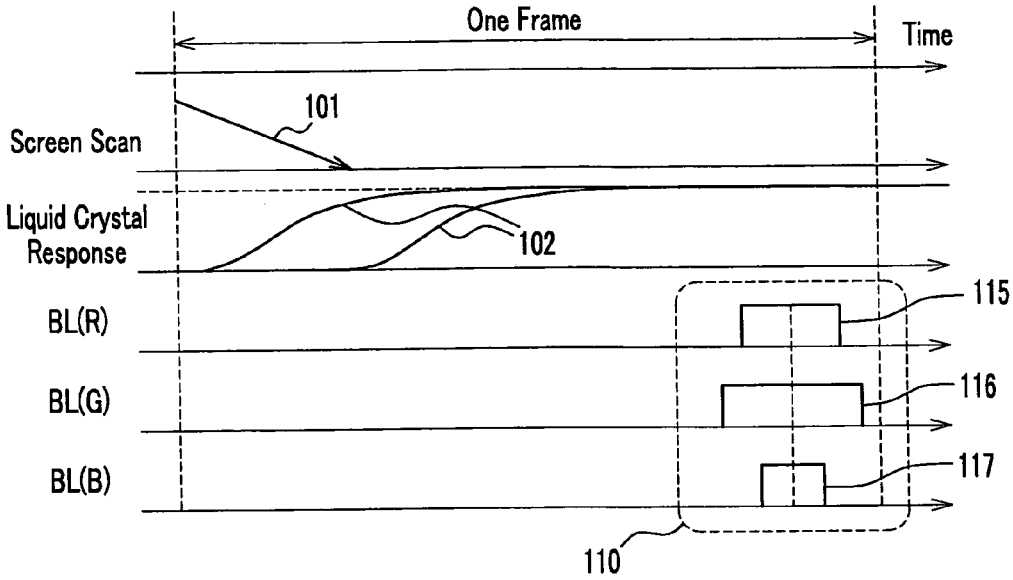
FIG. 5 is a display sequence diagram of a liquid crystal display device of an embodiment 2 of the present invention.

An embodiment 2 is same as the embodiment 1, excluding requirements below. A display sequence of the embodiment 2 is shown in FIG. 5. Different from the embodiment 1, the embodiment 2 does not divide the sequential emission period 110 of a backlight for each one frame into sub-emission periods and matches emission centers of emission periods 115, 116, and 117 of the three colors RGB. Ratios of a total emission length of the each color are same as those of the embodiment 1.

Figure 6:
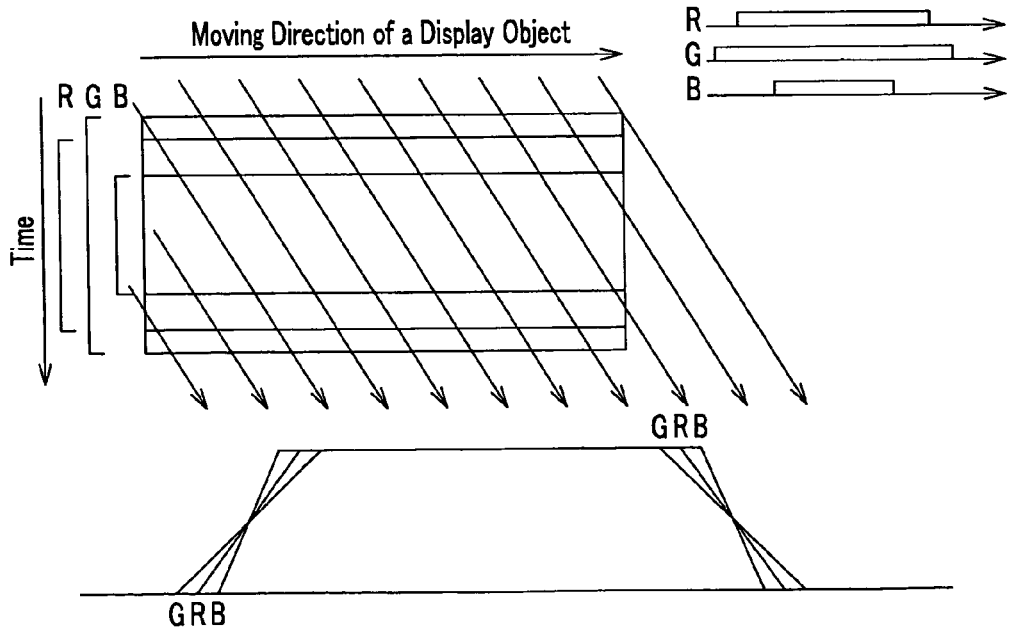
FIG. 6 is a drawing showing what an edge blur portion looks like in displaying a motion picture in the liquid crystal display device of the embodiment 2.

In a case of a motion picture being displayed when the emission center of each color matches within the sequential emission period 110 as in the display sequence of the embodiment, FIG. 6 shows what the picture looks like for a human being's eyes.

Although the displacement of the lines of the RGB is large, compared to FIG. 4 of the embodiment 1, it turns out that compared to FIG. 16 of the conventional example, the displacement of the lines of the RGB is reduced, and that thus the coloring becomes difficult to occur.

In the embodiment the emission length of the G is about four milli-seconds, and there are two times of 1.2 milli-seconds before/after an emission thereof as a period when the G is emitted and the B is not emitted. These are larger than one milli-second and smaller than 1.66 milli-seconds. Because the emission start timing and emission end timing of the G and B are displaced forward/backward, and in addition, the emission start timing and emission end timing from those of the R is similarly displaced forward/backward, the coloring is recognized a little bit more than that in the embodiment 1, however, a reduction effect of the coloring is large.

Thus because the liquid crystal display device of the embodiment uses the LED of the three colors RGB controllable for the each color as a backlight and matches the emission start timing and emission end timing of all the colors within the sequential emission period 110 of the backlight in a one-frame period, it can improve a motion picture display property by reducing the color displacement at an edge blur portion in displaying the motion picture.

Embodiment 3

Figure 7:
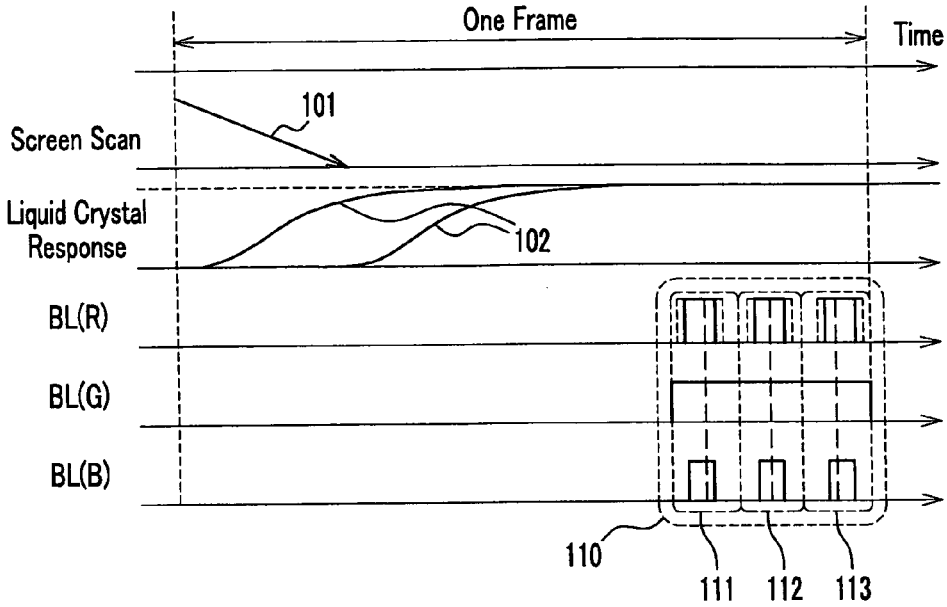
FIG. 7 is a display sequence diagram of a liquid crystal display device of an embodiment 3 of the present invention.

An embodiment 3 is same as the embodiment 1, excluding requirements below. A display sequence of the embodiment 3 is shown in FIG. 7. Although the embodiment 3 is same as the embodiment 1 in a point that the sequential emission period 110 of the backlight for each one frame is divided into the three sub-emission periods 111, 112, and 113, the emission start timing and emission end timing of the RGB do not match within the sequential emission period 110 and those within each of the sub-emission periods result in being disparate.

Although also in the embodiment the emission of the G is continuously emitted over all the sub-emission periods, with respect to the R and the B, the emissions of the R and the B are about 60% and about 40%, respectively. Meanwhile, in the embodiment the emission timing are not always same for all the three sub-emission periods.

Figure 8:
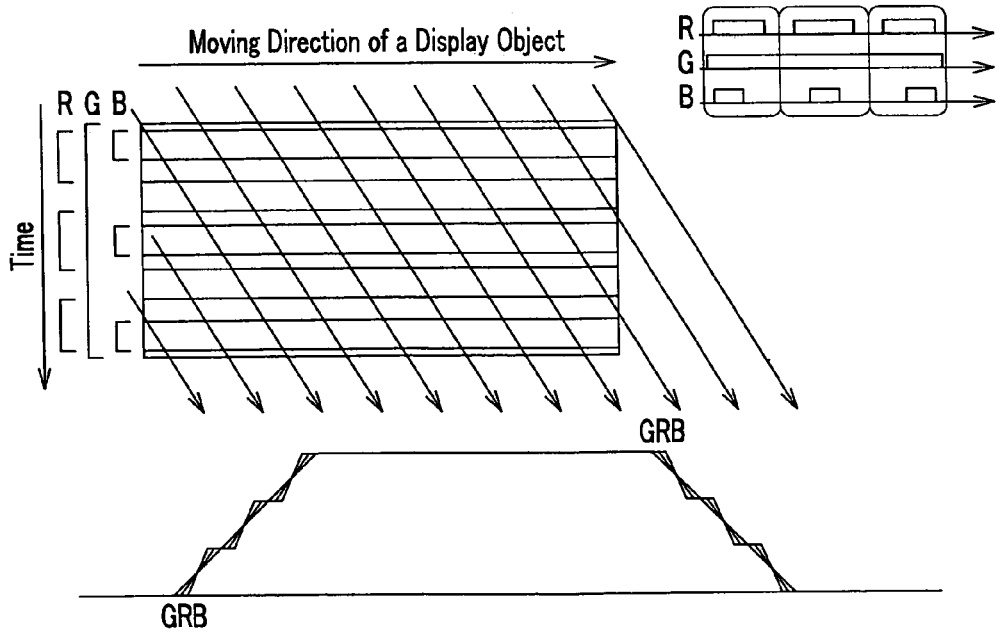
FIG. 8 is a drawing showing what an edge blur portion looks like in displaying a motion picture in the liquid crystal display device of the embodiment 3.

In a case of a motion picture being displayed when the emission of the each color is divided into the three sub-emission periods within the sequential emission period 110 as in the display sequence of the embodiment, FIG. 8 shows what the picture looks like for a human being's eyes. Compared to the displacement of FIG. 4 of the embodiment 1, that of the lines of the RGB results in becoming a little bit smaller.

In the embodiment the emission length of the G is about four milli-seconds, and there are two times of about one milli-second within each of the sub-emission periods as a period when the G is emitted and the B is not emitted. Due to this in displaying the motion picture, the coloring cannot be almost observed within an edge blur.

Thus the liquid crystal display device of the embodiment uses the LED of the three colors RGB controllable for the each color as a backlight, divides the two colors emissions of the R and the B into the three sub-emission within the sequential emission period 110 of the backlight in a one-frame period, thereby greatly reduces the color displacement at an edge blur portion in displaying the motion picture, and can improve the motion picture display property.

Embodiment 4

Figure 9:
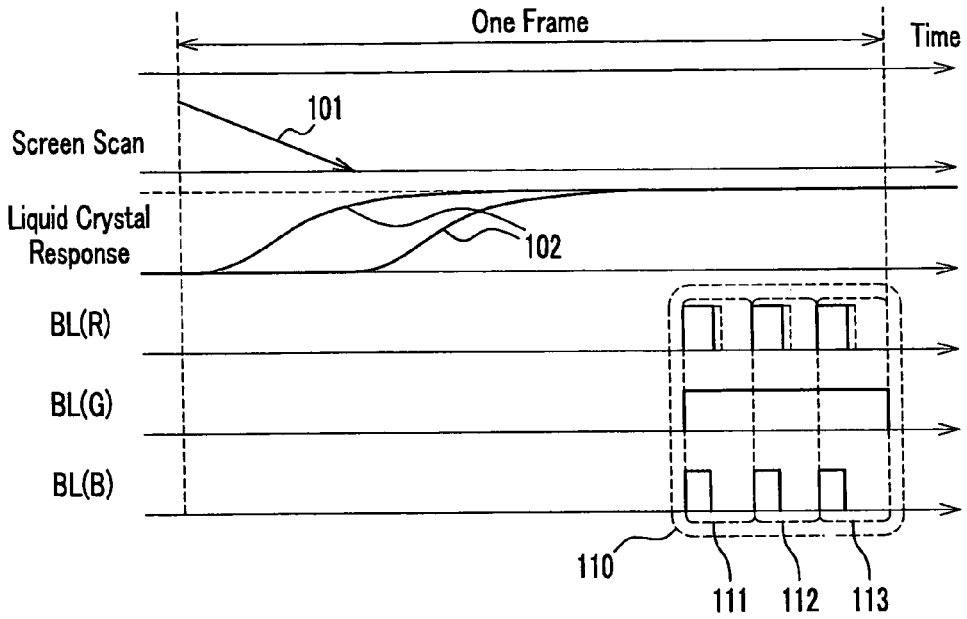
FIG. 9 is a display sequence diagram of a liquid crystal display device of an embodiment 4 of the present invention.

An embodiment 4 is same as the embodiment 3, excluding requirements below. A display sequence of the embodiment 4 is shown in FIG. 9. The embodiment 4 is same as the embodiment 3 in a point that the sequential emission period 110 of the backlight for each one frame is divided into the three sub-emission periods 111, 112, and 113; however, it is different from the embodiment 3 in a point that the emission start timing of the RGB matches within each of the sub-emission periods.

Also in the embodiment, although the emission o the G is continuously emitted over all the sub-emission periods, those of the R and the B are emitted within each of the sub-emission periods together with a start thereof and are about 60% and about 40%, respectively. Meanwhile, in the embodiment the emissions of the three sub-emission periods become a same condition. Thus a circuit size of an emission control circuit can be diminished.

For example, when adjusting nothing but the emission period of the R for a color tone compensation and the like, the emission period is adjusted by increasing/decreasing emission start time within each of the sub-emission periods. This is same for all the sub-emission periods.

Although when a motion picture is displayed in the display sequence of the embodiment, it is not specifically indicated a drawing of what the picture looks like for a human being's eyes, it is almost same as in the embodiment 3.

In the embodiment the emission length of the G is about four milli-seconds, and there are three times of 0.8 milli-second within each of the sub-emission periods as a period when the G is emitted and the B is not emitted. Because it is smaller than one milli-second, the coloring cannot be almost observed within an edge blur in displaying the motion picture.

Thus the liquid crystal display device of the embodiment uses the LED of the three colors RGB controllable for the each color as a backlight, divides the two colors emissions of the R and the B into three sub-emissions within the sequential emission period 110 of the backlight in a one-frame period, further uniforms the emission start timing within the sub-emission periods in the three colors RGB, thereby greatly reduces the color displacement at an edge blur portion in displaying the motion picture, and can improve the motion picture display property. In addition, because the emission start timing of the each color is same in each of the sub-emission periods, the embodiment can diminish a circuit size of the emission control circuit 202 and reduce cost.

Embodiment 5

Figure 10:
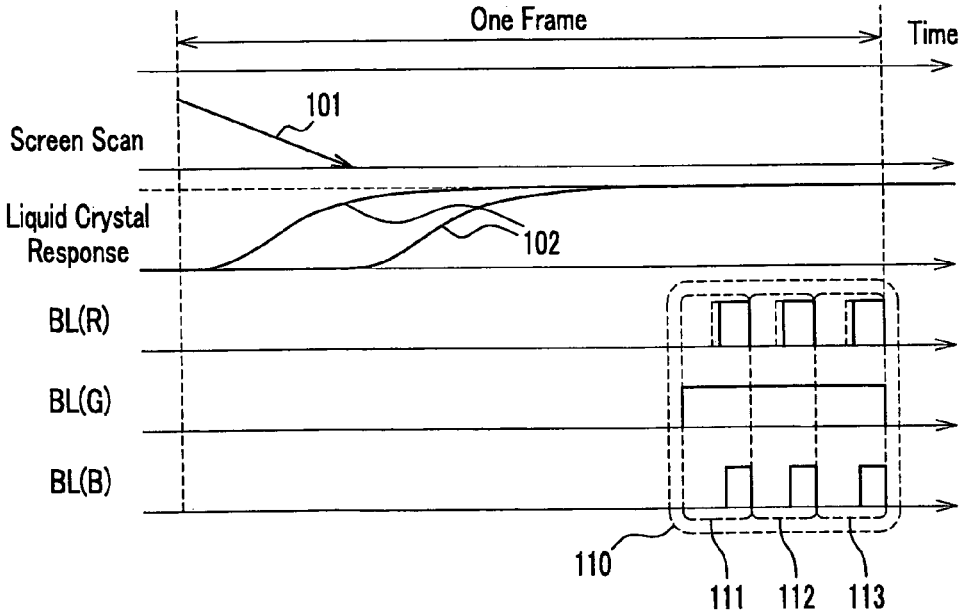
FIG. 10 is a display sequence diagram of a liquid crystal display device of an embodiment 5 of the present invention.

An embodiment 5 is same as the embodiment 3, excluding requirements below. A display sequence of the embodiment 5 is shown in FIG. 10. The embodiment 5 is same as the embodiment 3 in a point that the sequential emission period 110 of the backlight for each one frame is divided into the three sub-emission periods 111, 112, and 113; however, it is different from the embodiment 3 in a point that the emission end timing of the RGB matches within each of the sub-emission periods.

Also in the embodiment, although the emission of the G is continuously emitted over all the sub-emission periods, those of the R and the B end within each of the sub-emission periods together with an end thereof and are about 60% and about 40%, respectively. Meanwhile, also in the embodiment the emissions of all the three sub-emission periods become a same condition.

For example, when adjusting nothing but the emission period of the R for a color tone compensation and the like, the emission period is adjusted by increasing/decreasing the emission end time within each of the sub-emission periods. This is same for all the sub-emission periods.

Although when a motion picture is displayed in the display sequence of the embodiment, it is not specifically indicated a drawing of what the picture looks like for a human being's eyes, it is almost same as in the embodiment 3.

In the embodiment the emission length of the G is about four milli-seconds, and there are three times of 0.8 milli-second within each of the sub-emission periods as a period when the G is emitted and the B is not emitted. Because it is smaller than one milli-second, the coloring cannot be almost observed within an edge blur in displaying the motion picture.

Thus the liquid crystal display device of the embodiment uses the LED of the three colors RGB controllable for the each color as a backlight, divides the two colors emissions of the R and the B into three sub-emissions within the sequential emission period 110 of the backlight in a one-frame period, further uniforms the emission end timing within the sub-emission periods in the three colors RGB, thereby greatly reduces the color displacement at an edge blur portion in displaying the motion picture, and can improve the motion picture display property. In addition, because the emission end timing of the each color is same in each of the sub-emission periods, the embodiment can diminish a circuit size of the emission control circuit 202 and reduce cost.

Embodiment 6

Figure 11:
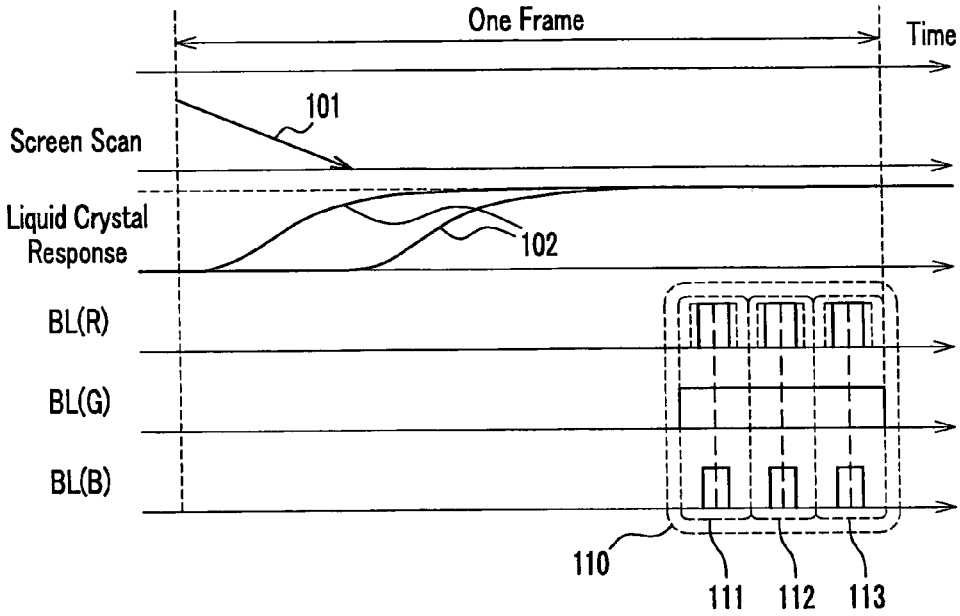
FIG. 11 is a display sequence diagram of a liquid crystal display device of an embodiment 6 of the present invention.

An embodiment 6 is same as the embodiment 3, excluding requirements below. A display sequence of the embodiment 6 is shown in FIG. 11. The embodiment 6 is same as the embodiment 3 in a point that the sequential emission period 110 of the backlight for each one frame is divided into the three sub-emission periods 111, 112, and 113; however, it is different from the embodiment 3 in a point that in the latter the emission start timing and emission end timing of the three colors RGB are disparate within each of the sub-emission periods, whereas in the former the emission centers of the RGB substantially match within each of the sub-emission periods in the three colors RGB.

Also in the embodiment, although the emission of the G is continuously emitted over all the sub-emission periods, with respect to the R and the B, each center of the sub-emission periods is designed to become a center of each emission within each of the sub-emission periods, and the emissions of the R and the G are about 60% and about 40%, respectively. Meanwhile, also in the embodiment the emissions of all the three sub-emission periods become a same condition.

For example, when adjusting nothing but the emission period of the R for a color tone compensation and the like, the emission period is adjusted by increasing/decreasing emission time forward/backward by same time within each of the sub-emission periods without displacing the emission center. This is same for all the sub-emission periods.

Figure 12:
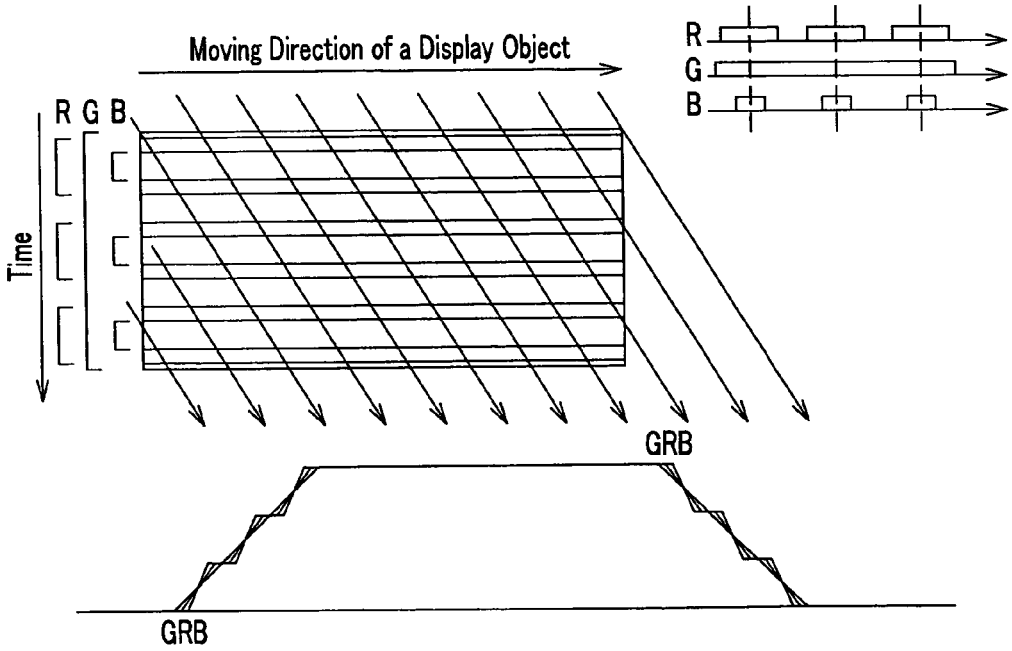
FIG. 12 is a drawing showing what an edge blur portion looks like in displaying a motion picture in the liquid crystal display device of the embodiment 6.

In a case of a motion picture being displayed when the emission center of each of the sub-emission periods matches within the sequential emission period 110 as in the display sequence of the embodiment, FIG. 12 shows what the picture looks like for a human being's eyes. With compared to FIG. 4 of the embodiment 1 and FIG. 8 of the embodiment 3, the displacement of the lines of the RGB results in becoming smaller.

In the embodiment the emission length of the G is about four milli-seconds, and there are two times of 0.8 milli-second within each of the sub-emission periods as a period when the G is emitted and the B is not emitted. Because it is smaller than one milli-second, the coloring cannot be almost observed within an edge blur in displaying the motion picture.

Thus the liquid crystal display device of the embodiment uses the LED of the three colors RGB controllable for the each color as a backlight, divides the two colors emissions of the R and the B into three sub-emissions within the sequential emission period 110 of the backlight in a one-frame period, further uniforms the emission centers of the R and the B within the sub-emission periods and furthermore uniforms that of the G, thereby greatly reduces the color displacement at an edge blur portion in displaying the motion picture, and can improve the motion picture display property. In addition, because the emission center of the G and those of the R and the B within the sub-emission periods are same, the embodiment can diminish a circuit size of the emission control circuit 202 and reduce cost.

Embodiment 7

Figure 13:
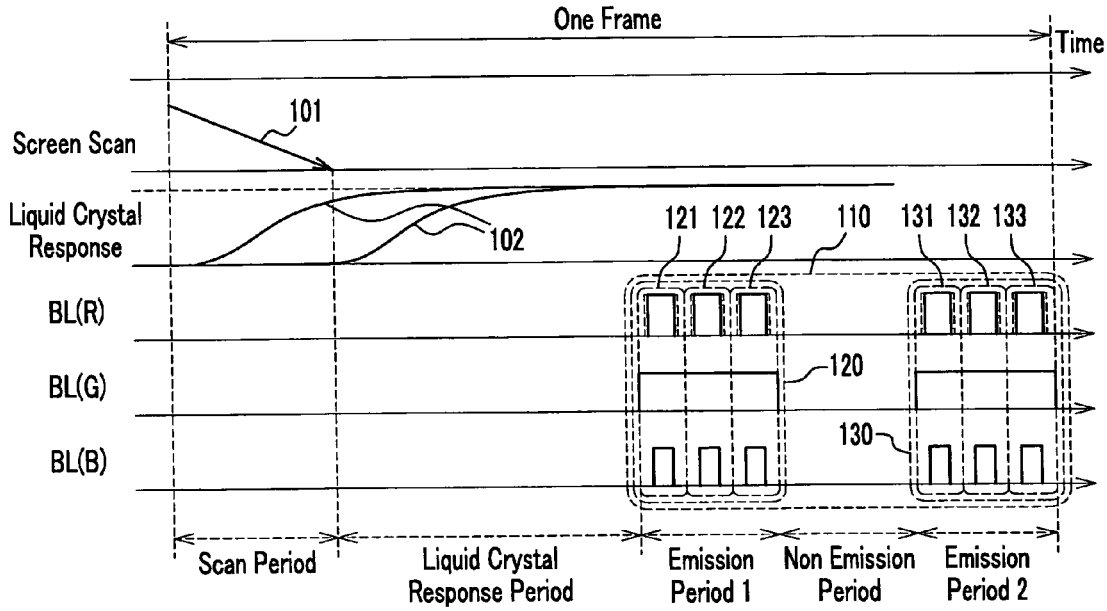
FIG. 13 is a display sequence diagram of a liquid crystal display device of an embodiment 7 of the present invention.

An embodiment 7 is same as the embodiment 6, excluding requirements below. A display sequence of the embodiment 7 is shown in FIG. 13. The embodiment divides the sequential emission period 110 of the backlight for each one frame into large two of a first emission period 120 and a second emission period 130. And the embodiment further divides the first emission period 120 and the second emission period 130 into respective three sub-emission periods of 121, 122, and 123 and 131, 132, and 133. The emissions of the RGB within the sub-emission periods in each of the emission periods are same as in the embodiment 6, and the emission centers of the RGB substantially match in the three colors.

In the first emission period 120 and the second emission period 130, although the emission of the G is continuously emitted over all the sub-emission periods 121 to 123 and 131 to 133, with respect to the R and the B, each center of the sub-emission periods is designed to become a center of each emission within each of the sub-emission periods, and the emissions of the R and the B are about 60% and about 40%, respectively. Meanwhile, in the embodiment the emissions of all the six sub-emission periods become a same condition.

For example, when adjusting nothing but the emission period of the R for a color tone compensation and the like, the emission period is adjusted by increasing/decreasing emission time forward/backward by same time within each of the sub-emission periods without displacing the emission center. This is same for all the sub-emission periods.

Because an emission property is same as in the embodiment 6 in all the sub-emission periods, the coloring cannot be almost observed within an edge blur in displaying the motion picture.

On the other hand, all emissions of the RGB stop between the first emission period 120 and the second emission period 130, and the period between them completely becomes a non emission condition. In the embodiment the non emission condition period is designed to become about four milli-seconds. By thus largely dividing the sequential emissions within one frame into two and substantially emitting light two times repeatedly within a one-frame, an image deterioration, which is apt to occur in such an impulse-type display system, due to a flicker interference can be improved.

In this case it is important to make an interval of the emission periods not less than three milli-seconds so as to be detected by a human being's eyes. In addition, an improvement effect of the flicker interference is largest when the interval and another interval from an end of the second emission period to a start of the first emission period of the next frame are equal, that is, an emission frequency is made double of a frame frequency.

But because when a liquid crystal response does not end until then, a ghost results in occurring in the motion picture, an optimal value of the interval exists between zero and a half frame cycle. This depends on the screen scan 101 and the liquid crystal response 102 on/to the display unit 205, and when adjusted, the optimal value may be adjusted according to the screen scan 101 and the liquid crystal response 102.

Meanwhile, the embodiment is a liquid crystal display device for displaying a PAL (Phase Alternation by Line) system whose one frame is about 20 milli-seconds, wherein a scan period is made about four milli-seconds, a liquid crystal response period about eight milli-seconds, and each of the first and second emission periods two milli-seconds, whereby the non emission period is fixed four milli-seconds.

Thus the liquid crystal display device of the embodiment uses the LED of the three colors RGB controllable for the each color as a backlight, largely divides the sequential emission period 110 of the backlight within the one-frame period into two, further divides the emissions of the two colors R and B within the sub-emission periods into the three-sub-emission periods in the emission periods, furthermore uniforms the emission centers within the sequential emission period 110 in the three colors RGB, and thereby greatly reduces the color displacement at an edge blur portion in displaying the motion picture, and can improve the motion picture display property. In addition, because the emission centers within the emission periods of the each color are same, the embodiment can diminish a circuit size of the emission control circuit 202 and reduce cost.

Furthermore, because the emission periods are respectively largely divided into two, it is enabled to reduce an image deterioration such as the flicker interference.

Meanwhile, in the embodiment, although the emission centers matches same as in the embodiment 6 in the emissions of the RGB within each of the sub-emission periods, the emission start timing may match as in the embodiment 4, and the emission end timing may match as in the embodiment 5. In addition, as in the embodiment 3, these timing may be disparate.

Embodiment 8

Figure 14:
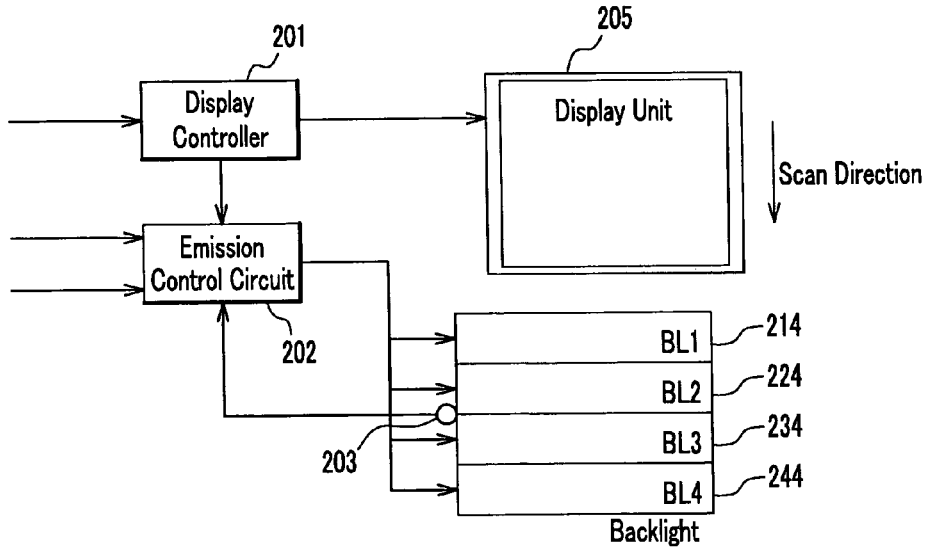
FIG. 14 is a display block diagram of a liquid crystal display device of an embodiment 8 of the present invention.

An embodiment 8 is same as the embodiment 6, excluding requirements below. A display sequence of the embodiment 8 is shown in FIG. 14. The embodiment 8 is different from the embodiment 1 in the block diagram of FIG. 2 in a point that in an image scan direction of the display unit 205 each emission area of a backlight is divided into four (BL1 to BL4), a first emission unit 214, a second emission unit 224, a third emission unit 234, and a fourth emission unit 244 in order of the image scan direction.

Figure 15:
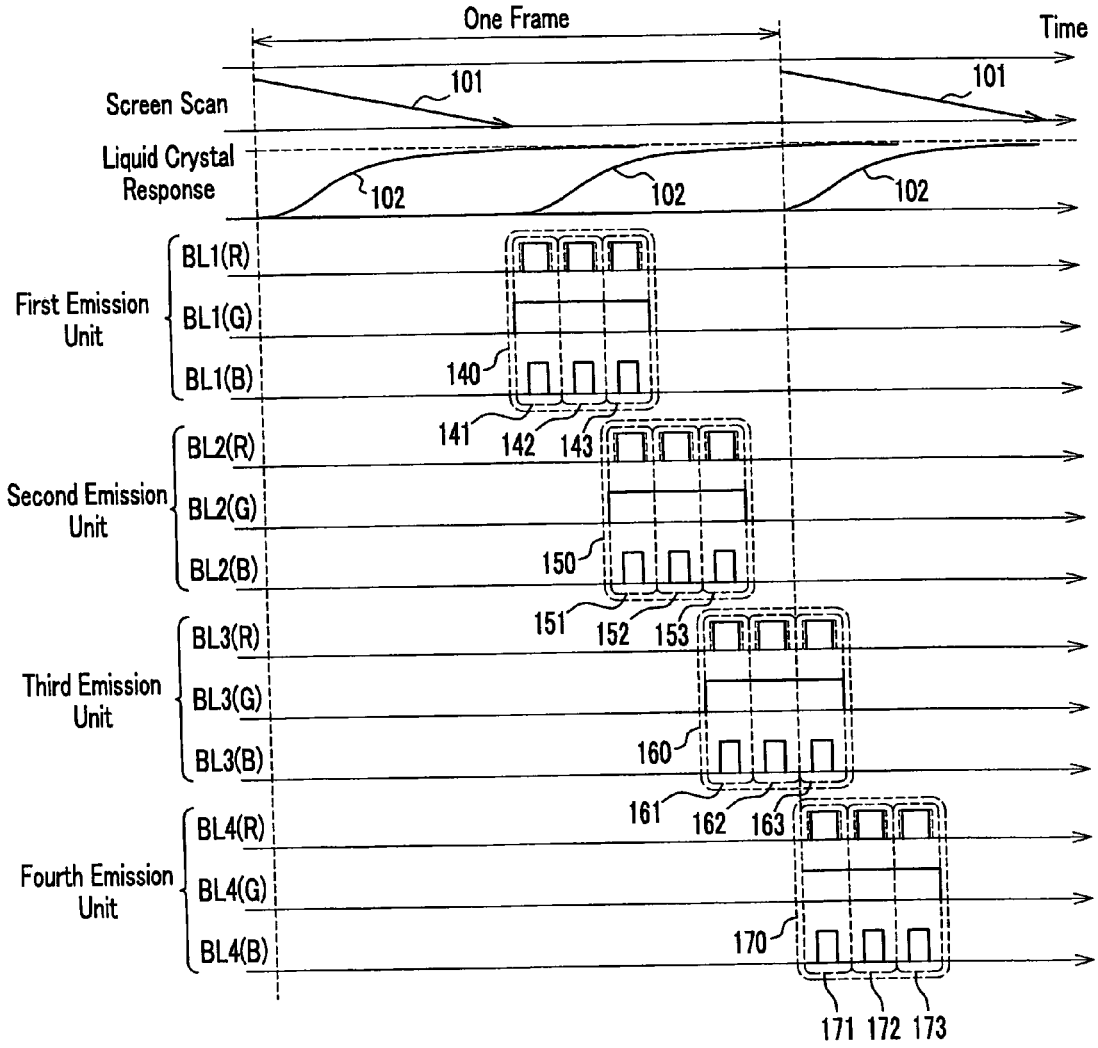
FIG. 15 is a display sequence diagram of the liquid crystal display device of the embodiment 8.

And in an emission sequence of each of the emission units, as shown in FIG. 15, a sequential emission period 140 for the emission unit 214, a sequential emission period 150 for the emission unit 224, a sequential emission period 160 for the emission unit 234, and a sequential emission period 170 for the emission unit 244 are different in respective emission timing and are displaced in time in order of the image scan direction.

In the embodiment the emission timing of the four emission units is displaced in synchronization with a scan from a screen upper portion to a lower one according to the screen scan 101; and although after an extent of time of a liquid crystal response of a pixel starting and substantially ending according to the screen scan, an emission of the each area starts, the screen scan and the emission timing of the each area may not be synchronized.

The sequential emission period of the each emission unit is divided into three sub-emission periods as in the embodiment 6, and each emission of the RGB is emitted so that an emission center thereof matches.

When dividing a backlight into a plurality of areas, sequentially displacing the emission timing of each divided backlight from a screen upper portion to a screen lower one, and thereby checking a liquid crystal response in the screen corresponding to one divided area, it can be thought that the screen scan period thus described is reduced to a period divided by a division area number. Reversely describing this, as one screen the screen scan period can be made longer.

Accordingly, in the embodiment the screen scan period, which is about four milli-seconds in the embodiment 6, is designed to be double, eight milli-seconds. Because write time into each pixel in the image scan of a display thus becomes double in length, writing into each pixel is sufficiently performed, and thereby an image defect can be further reduced.

Thus the liquid crystal display device of the embodiment divides an emission area as a backlight into four, each area uses the LED of the three colors RGB controllable for the each color, sequential emissions within a one-frame period of each emission area are different in timing for each emission area, divides the emissions of the two colors R and B within the sequential emission period of the each emission area into the three-sub-emissions, furthermore uniforms emission centers within emission periods in the three colors RGB, and thereby greatly reduces the color displacement at an edge blur portion in displaying the motion picture, and can improve the motion picture display property.

In addition, because the emission timing of the each color is same in the sub-emission periods, the liquid crystal display device of the embodiment can diminish the circuit size of the emission control circuit 202 and reduce cost. Furthermore, because the emission area is divided into four and light is emitted at different timing, the write time in each pixel becomes double in length; and thereby writing in each pixel can be sufficiently performed, and the liquid crystal display device can further diminish the motion picture display property.

Meanwhile, although in the emissions of the RGB of the embodiment within each of the sub-emission periods the centers of the emissions match same as in those of the embodiment 6, the emission start timing may match as in those of the embodiment 4, and the emission end timing may match as in those of the embodiment 5. In addition, theses timing may be disparate as in the emissions of the RGB of the embodiment 3.

What is claimed is:

1. A liquid crystal display device comprising:

a liquid crystal display unit for displaying an image;

light sources of three original colors of red, green, and blue independently;

a backlight unit controllable for each color that radiates light at said liquid crystal display unit;

a display controller for controlling a display of the liquid crystal display unit; and an emission control circuit for controlling an emission of at least one color of the backlight unit, wherein said emission control circuit divides an emission period of at least one color of the backlight unit in a sequential emission period within a one-frame period into a plurality of sub-emission periods, and performs control so that emission start timing and emission end timing in the sequential emission period within the one-frame period of the at least one color match in three original colors and so that an emission center of the at least one sub-mission period in the sequential emission period within the one-frame period of the at least one color matches in the three original colors, wherein an emission length of one color emitting light differs from an emission length of another color emitting light within the one sub-emission period in the one frame.

2. A liquid crystal display device according to claim 1, wherein emission intensity of said backlight unit controls and adjusts a length of an emission period within said sequential emission period.

3. A liquid crystal display device according to claim 1, wherein displacement of emission timing of the at least one color within said sequential emission period is at least not more than three milli-seconds.

4. A liquid crystal display device according to claim 1, wherein displacement of emission timing of the at least one color within said sequential emission period is at least not more than 1.6 milli-seconds.

5. A liquid crystal display device according to claim 1, wherein is displacement of emission timing of the at least one color within said sequential emission period is at least not more than one milli-second.

6. A liquid crystal display device according to claim 1, wherein said sequential emission period is repeated within a one-image display period.

7. A liquid crystal display device according to claim 6, wherein an interval of said repeated sequential emission period is not less than three milli-seconds.

8. A liquid crystal display device according to claim 6, wherein an interval of said repeated sequential emission period changes, depending on one-image write time of said liquid crystal display unit and response time of a liquid crystal material.

9. A liquid crystal display device according to claim 1, wherein an emission area of said backlight unit is divided into not less than two, and an interval of said sequential emission period differs in emission timing for each divided emission area.

* * * * *